United States Patent [19]

Keefe

[11] Patent Number: 4,621,251

[45] Date of Patent: Nov. 4, 1986

[54] ELECTRIC RESISTANCE HEATER ASSEMBLY

[75] Inventor: Richard A. Keefe, Wilmette, Ill.

[73] Assignee: North American Philips Corp., New York, N.Y.

[21] Appl. No.: 717,300

[22] Filed: Mar. 28, 1985

[51] Int. Cl.[4] ..... H05B 3/40; H01C 1/148; H01C 3/20

[52] U.S. Cl. ..... 338/302; 219/236; 219/238; 219/541; 219/544; 338/264; 338/266; 338/329; 338/332

[58] Field of Search ..... 219/221, 227–232, 219/236–241, 544, 541; 338/302, 264–267, 270, 329, 332

[56] References Cited

U.S. PATENT DOCUMENTS

| | | | |
|---|---|---|---|
| 744,974 | 11/1903 | McElroy | 338/298 |
| 2,041,018 | 5/1936 | Persons | 219/239 X |
| 2,398,686 | 4/1946 | Zander | 338/266 X |
| 2,402,122 | 6/1946 | Bullinger | 338/266 X |
| 2,875,309 | 2/1959 | Pearce | 338/302 |
| 2,879,361 | 3/1959 | Haymman | 338/302 |
| 3,248,679 | 4/1966 | Ganci | 338/264 |
| 3,287,541 | 11/1966 | Weller et al. | 219/241 |
| 3,707,258 | 12/1972 | Schlitt | 228/52 |
| 3,889,096 | 6/1975 | Asselman et al. | 219/229 |
| 3,943,326 | 3/1976 | Henry | 219/241 |
| 4,035,613 | 7/1977 | Sagawa et al. | 219/552 |
| 4,438,322 | 3/1984 | Sylvia | 219/236 |
| 4,439,667 | 3/1984 | Sylvia | 219/230 |

FOREIGN PATENT DOCUMENTS

| | | | |
|---|---|---|---|
| 669393 | 12/1938 | Fed. Rep. of Germany | 338/302 |
| 804816 | 4/1951 | Fed. Rep. of Germany | 338/302 |
| 1170089 | 5/1964 | Fed. Rep. of Germany | 219/236 |
| 2059873 | 8/1973 | Fed. Rep. of Germany | 219/236 |
| 418624 | 2/1947 | Italy | 219/238 |
| 264850 | 2/1950 | Switzerland | 338/302 |
| 267161 | 6/1950 | Switzerland | 338/302 |
| 288859 | 4/1920 | United Kingdom | 219/238 |
| 504838 | 5/1939 | United Kingdom | 219/238 |

*Primary Examiner*—A. Bartis
*Attorney, Agent, or Firm*—Eugene I. Snyder

[57] ABSTRACT

An improved electric resistance heater assembly for soldering tools, glue guns, hair dryers, heat pencils, paint removers, etc., includes, as the core of the assembly, an open-ended tube of a ceramic material having good electrical insulation properties with good thermal conductivity, low heat capacity and a high softening temperature. A conduit extends lengthwise through the wall of the tube from end to end thereof and first and second spring-tempered split metallic compression bands of smaller diameter than the tube are placed at each end of the tube and retained thereon by compressive stress. A plurality of turns of resistance wire are wound about the outer periphery of the tube between the bands with each end of the wire welded to a respective one of the bands. An first electric lead is welded to the first band. A second electric lead is welded to the second band and extends lengthwise through the conduit and exits the conduit near the first band. The assembly permits the separation of the resistance wire winding process from the electrical connection process, leading to simplicity in design and manufacturing procedures.

3 Claims, 4 Drawing Figures

FIG. 1
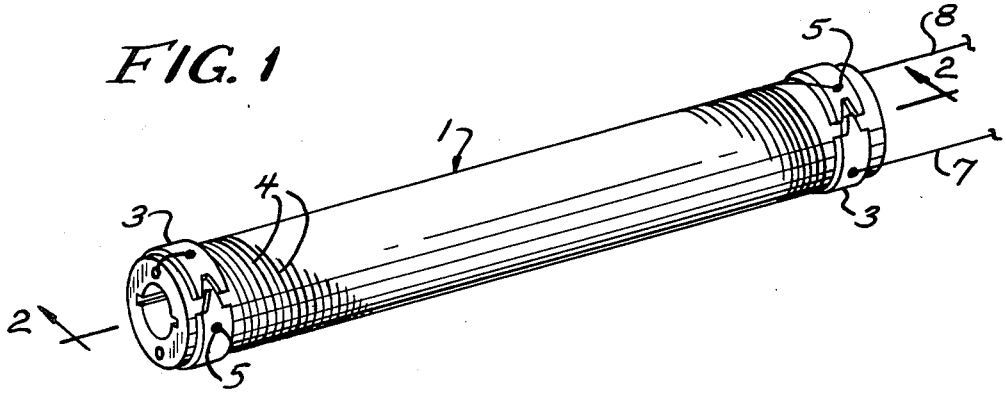
FIG. 2
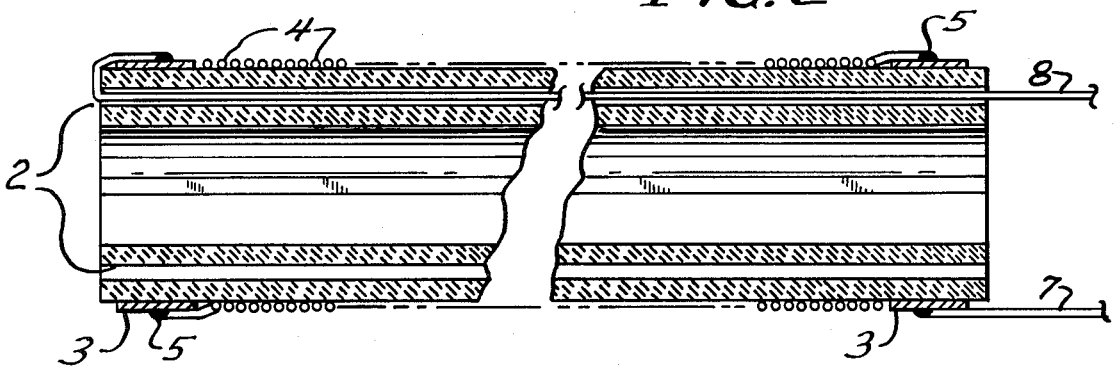
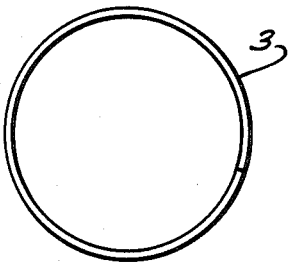
FIG. 3
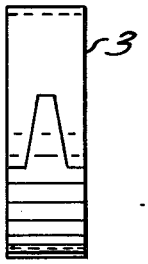
FIG. 4

ELECTRIC RESISTANCE HEATER ASSEMBLY

Although the use of an electrical resistance wire winding as a heating element has been known virtually since the advent of electrical devices, nonetheless its use remains undiminished with time. Such a heating element is the quintessence of simplicity—in design, in function, in operation—which unquestionably is largely responsible for its longevity. Such a heating element, as may be used in soldering and glue tools, hair dryers, paint removers, plastic cutters, wood and plastic embossers, and heat pencils, to mention only several representative devices, is the subject matter of my invention. For the purpose of simplifying exposition reference will be made to assemblies used in soldering and glue guns, but it is to be clearly understood solder and glue guns are used in a representative capacity only.

A common means of providing heat to a soldering tip is to have the tip connected to a metal rod or tube which is heated by resistance wire. For example, U.S. Pat. No. 3,889,096 broadly discloses that in soldering irons heating of the soldering element may be effected by means of an electric resistance heating wire wound as a coil around a "transmission wall." A heater assembly which is a wire wound around, but electrically insulated from, a barrel of high thermal conductivity material, contemplated to be a metal, is referred to in U.S. Pat. No. 3,943,326. In both 4,438,322 and 4,439,667 the same patentee describes a heating element composed of resistance wire wound on a metal, tubular sleeve coated with electrically insulating ceramic, with the entire winding subsequently imbedded in, or covered by, an electrically insulating ceramic. Finally, U.S. Pat. No. 3,707,258 refers to a heating cartridge used to heat solder passing through the core of a ceramic tube provided with a heating coil.

The above assemblies, which are representative of the art, share deficiencies common to such devices. For example, where the wire is wound on a metal tube or cylinder numerous problems are present. One is that heater wattage is limited by the tendency of most metals to soften, or even melt, during heating, leading to material breakdown and eventually insulator breakdown. Another problem is that the resistance wire needs to be electrically insulated from the metal tube. Generally this is done by wrapping the metal with an insulator such as mica, and coiling the resistance wire tightly thereon. Almost invariably the mica cracks or breaks, causing an electrical short and failure. The solution offered by the patentee of U.S. Pat. No. 4,438,322 of using a ceramic coated metal tube alleviates this problem, but presents technical complications in fabricating such a tube. Yet another problem is that the relatively high heat capacity of most metals leads to appreciable time lags both in solder tip heating after the heater assembly is energized and in cooling after the heater assembly is de-energized. Such time lags frequently are exacerbated by the relatively poor thermal conductivity of an electrically insulating layer, such as mica, wrapped around the metal tube.

Resistance wire heaters share a common design problem, closely related to the manufacturing process, associated with the electrical connections to the termini of the resistance winding. One design, as typified in U.S. Pat. No. 3,287,541, has resistance wire wound on a cylinder in a bifilar manner in a single layer on a cylinder, with an insulating sheet such as mica over the winding and the second terminus of the winding doubled back over the insulating layer. Another design has one layer of winding on a cylinder, an insulating sheet over the first layer, and a second layer over the insulating sheet wound in the reverse direction. As with the prior design, both termini of the resistance winding are at a common end of the cylinder. A third design, exemplified in U.S. Pat. No. 4,438,332, has the termini of the resistance winding at opposite ends of a cylinder, with the winding at each end wrapped around lead wires bent into an S-shape and the entire winding being coated with ceramics. A fourth design, as in U.S. Pat. No. 4,035,613, has the resistance wire wound separately to form a spring-like unit which is inserted into a honeycomb ceramic tube, or which has powdered ceramic compacted around the coil, the coil being in such a configuration that the two termini are at the same end of the heater element.

Each of these designs share deficiencies arising from the same limitation, viz., the process of winding the resistance coil is both complicated and confused with the need for insulating the coil from the metal base and/or cover and the need to provide electrical input. The first two designs lead to excessive electrical breakdown at the connections of the resistance winding with electrical leads, most often because of electrical breakdown of the insulating layer. When the winding is energized it tends to weave and undulate somewhat, causing mica, as an example of a common insulator, to crack, fracture, and ultimately break leading to electrical shorts and heater failure. The third design recognized this problem and offers a rigid mass as a solution. Unfortunately, the solution offered is not susceptible to inexpensive mass production techniques. The fourth design suffers from similar shortcomings.

A major difference between the currently available heating elements using a resistance wire winding and my invention is that in the prior art heaters there is inadequate separation during production of the two electrical connections as distinct manufacturing steps, where as in the heater element herein such connections are quite separate and are unrelated to the winding process.

Recapitulating, the needs of the marketplace for a heater assembly of a resistance wire wound on a tubular form include: (1) a tubular portion with good thermal conductivity and low heat capacity, with (2) a sufficiently high softening or thermal breakdown point to be usable in high wattage heaters, preferably (3) an electrical insulator, so designed that (4) winding of resistance wire may be effected by simple, high speed mass production techniques, with (5) a simple, facile, and separate assembly between the electrical leads and heater coil affording (6) a good mechanical connection and excellent electrical contact between the leads and winding so that shorting of such connections is virtually non-existent.

The invention herein is a device meeting all these needs. It is a heater assembly which heats (and cools) very rapidly, thereby working efficiently and conserving energy. For example, the heater assembly of this invention can come to soldering temperature within 30 seconds whereas the identical configuration using a mica-wrapped stainless steel assembly requires three minutes to reach the same temperature. It is a heater assembly which is quite stable toward electrical breakdown. For example, such an assembly can operate continuously at 1100° F. for several weeks without breakdown, whereas a mica-wrapped stainless steel breaks down after several days, sometimes even after only several hours. It is a heater assembly which can be used even at high wattage because the tubular portion undergoes no significant mechanical or physical change even with prolonged use at high temperatures. It is a heater assembly which readily withstands 2500 volts without failure, whereas most other heaters tend to experience breakdown at the connection to the wire leads under such a test. And perhaps most important of all it is a heater assembly which can be fabricated economically and conveniently using a winding process well known to the art of making resistors.

One aspect of my invention is the use of a ceramic tube having excellent thermal conductivity, low heat capacity, a high softening point, and which is an outstanding electrical insulator. Another aspect of my invention arises from use of a simple, reliable, high speed winding process whereby the resistance wire is wound in a manufacturing stage distinct and separate from making the electromechanical connections to the electrical leads. Yet another aspect is the separate electromechanical connection to the electrical leads which affords exceptionally low electrical failure rates.

The heater assembly of this invention is essentially a ceramic tube having at least one longitudinal passageway through the wall of the tube going from one end to the other, resistance wire wound around the ceramic tube and held firmly in place by compression bands on the outside of each end of the tube, with a first lead wire connected as by soldering or welding to one compression band, and a second lead wire passing through the passageway from the same side as the first lead wire to the other side of the tube and connected as by soldering or welding to the other compression band.

DESCRIPTION OF THE FIGURES

FIG. 1 is a perspective view of the heater assembly.

FIG. 2 is a longitudinal section of the heater assembly through 2—2.

FIGS. 3 and 4 are side and end views, respectively, of the compression bands.

DESCRIPTION OF THE INVENTION

My invention is a heater assembly, intended for use in articles such as a solder or glue gun, where the heat is generated from resistance winding wrapped on a ceramic tubular structure, the ceramic having characteristics described in greater detail within, and the heat used from the inner portions of said tubular structure. It will be recognized that such a heater assembly can be used for a broad range of articles, some of which were mentioned above, and all such uses are within the scope of my invention. In practice, a metal rod which is, or is part of, the soldering tip will be inserted into and in close contact with the tubular structure when the assembly is used in a solder gun, so that the heat generated by the heater assembly will be efficiently transferred to the metal rod. However, in other uses, such as in a hair dryer, air will be blown around the assembly and through its inner portion and will be the heat transfer medium.

The details of my invention are better understood with reference to the figures. FIG. 1 is a perspective view of the assembly showing all its elements. The tubular body, 1, is a ceramic with quite distinct properties. In particular, the ceramic has a softening point no less than about 2000°, to ensure that the heater assembly is adaptable to relatively high wattages. The ceramic must also be a good thermal conductor with low heat capacity. This combination assures rapid heating (and cooling) with maximum efficiency. The ceramic needs to be a good electrical insulator, since the tubular assembly often will slip over a metal rod. Finally, the requisite tubular structure should be able to be readily fabricated, preferably by extrusion, with a reasonable degree of precision. Illustrative of the ceramic materials which can be used in the practice of this invention are alumina, beryllia, titania, steatite, forsterite, cordierite, zirconium silicates, aluminum silicates, and lithia, with alumina being a preferred material because of its relatively high thermal conductivity and beryllia, titania, and lithia being somewhat preferred. In some cases electrical porcelains may be utilized.

The tubular ceramic body has at least one longitudinal passageway or conduit, 2, in the wall passing from end to end. This conduit is of a diameter sufficient to accommodate the electrical leads, 7. This feature is seen more clearly in FIG. 2. Near each end of the ceramic tube are compression bands, 3, which tightly grip the surface of the ceramic tube. Such bands are made of electrically conductive material and preferably have a spring temper. That is, the bands can be expanded so that they can be easily slipped onto the ceramic tube, but once on the bands fit very tightly and are essentially unmovable. The bands are shown in detail in FIG. 3.

Between the bands is wrapped resistance wire, 4. For any given resistance wire and ceramic tube the number of turns and the diameter of the wire will determine the heater wattage. One advantage of the heater assembly of our invention is its enormous versatility. Heaters up to 250 watts can be constructed from only two sizes of ceramic tubes merely by varying the pitch of the windings (i.e., number of turns) and the diameter of the resistance wire.

Each terminus, 5, of the resistance winding is firmly attached to the compression bands. Such attachment is both a good mechanical connection, so as to provide a strong, rigid structure, and a good electrical connection so that there is low electrical resistance in the heater everywhere but in the resistance windings. A good mechanical and electrical connection can be made simultaneously be welding each terminus to the compression band, although other means of connection are not intended to be excluded.

Two electrical leads complete the device. One such lead, 7, is connected directly to a compression band. As stated above, such connection must be mechanically strong and give rise to little or no electrical resistance. As above, spot welding the lead to the band, especially at a point different from the connection 5, of the resistance winding, affords such a connection. The other lead, 8, comes from the same side but enters the conduit, exiting at the opposite end of the tube where it is bent over the top of said tube and connected to the other band in the same manner as was described for lead 7.

In practice the heater of this invention may be made by high speed mass production techniques with great precision and quite low cost. Production begins by placing the ceramic tube on a spindle and holding it firmly thereon. A compression band is placed near each end of the tube, and the end of a resistance wire is spot welded to one band. The resistance wire is then laid over a threaded cylinder to the wire supply, and both the spindle and threaded cylinder are rotated synchronously so as to wind the wire onto the tubular form with a precisely controlled pitch. Such a method of precision winding is well known in the resistor fabrication art and need not be further elaborated on here. When the desired number of turns of wire has been laid down the wire is then spot welded to the other band, and the wire cut at the weld.

The tube with the wire winding is then removed from the spindle and in a subsequent production step the two lead wires are connected. The separation of the winding process from leads connection is, as previously emphasized, an important feature of this invention. One lead connection is made by simply connecting, as by spot welding, a lead to one band. The other lead enters the conduit from the same side as this latter band and exits at the other end, where it is doubled back onto the other band and connected thereto, as by spot welding. The connections of the leads to the resistance winding via the compression bands leads to a heater assembly with an exceptionally low failure rate, in constrast with prior art heaters which invariably show high failure rates at such connection points.

Separation of the winding process from the electrical connecting process does not impede production. For example, a worker with great skill in winding heaters of the metal-rod-and-mica type can produce 200–300 of the latter per workday. The same worker can, on the second workday, wind 1100 heaters of this invention, and a second, similarly skilled person can readily perform the connections to the electrical leads for this output in the same workday. Thus, 550 units of my new heater assembly per worker per workday is readily achievable, whereas the production rate for the prior art heaters is more like 250 per worker per workday.

It will be appreciated by those skilled in the art that many designs of the aforedescribed heater assembly are possible, and the embodiment depicted in FIG. 1 is but one of many. Such diverse embodiments are but variations on the theme of my invention, all of which are within the spirit and intent of my invention and thereby encompassed by it.

What is claimed is:

1. A heater assembly consisting essentially of a ceramic tube through whose wall there is at least one longitudinal conduit extending from one terminus to the other terminus of said tube, compressions bands tightly fitted on the outer surface of the tube and placed transversely to its long axis, each of said bands being a resilient spring-temper split band of smaller diameter than the tube so as to be self-retained thereon by compressive stress, a first band being adjacent to one terminus of the tube and a second band being adjacent to the other terminus, resistance wire tightly wound around the tube between said bands with one terminus of said wire welded to the first band and the other terminus of the wire welded to the second band, a first electrical lead welded to the first band, a second electrical lead welded to the second band and extending through the conduit in the wall of the tube to exit at the terminus adjacent to the first band, each of said electrical lead welds being at a point on the band separate from the point of welding of the resistance wire.

2. The assembly of claim 1 where the ceramic is selected from the group consisting of alumina, beryllia, titania, steatite, forsterite, cordierite, zirconium silicates, aluminum silicates, and lithia.

3. The assembly of claim 2 where the ceramic is alumina.

* * * * *